United States Patent [19]

Pearl

[11] Patent Number: 4,732,064

[45] Date of Patent: Mar. 22, 1988

[54] APPARATUS AND METHOD FOR SHARPENING EDGES OF RECIPROCATING BLADE

[75] Inventor: David R. Pearl, West Hartford, Conn.

[73] Assignee: Gerber Garment Technology, Inc., Tolland, Conn.

[21] Appl. No.: 21,994

[22] Filed: Mar. 5, 1987

[51] Int. Cl.[4] ..... B26D 7/12

[52] U.S. Cl. ..... 83/13; 83/174; 51/247; 51/327; 76/82

[58] Field of Search ..... 83/174, 925 CC, 174.1, 83/13; 51/247, 249, 327, 246, 248; 76/82, 85

[56] References Cited

U.S. PATENT DOCUMENTS 3,507,177 4/1970 Baldwin ..... 83/174

4,033,214 7/1977 Pearl ..... 83/174

4,294,047 10/1981 Pearl ..... 83/174

4,442,599 4/1984 Clark ..... 83/174

*Primary Examiner*—E. R. Kazenske

*Assistant Examiner*—Eugenia A. Jones

*Attorney, Agent, or Firm*—McCormick, Paulding & Huber

[57] ABSTRACT

A cutting machine for cutting layups of sheet material has a reciprocating blade suspended from a platform above a support surface for the material. A blade sharpener is also suspended from the platform and comprises at least one sharpening wheel for engagement with the cutting edge of the blade. The sharpening wheel is mounted on a rotatably driven shaft, and includes an abrasive surface disposed about an axis of symmetry which in turn is arranged in angular relation to the axis of the shaft. The angular arrangement of the axes of symmetry and the shaft ensures contact between a limited portion of the abrasive surface and the cutting edge of the blade during sharpening operations.

9 Claims, 8 Drawing Figures

APPARATUS AND METHOD FOR SHARPENING EDGES OF RECIPROCATING BLADE

BACKGROUND OF THE INVENTION

This invention relates in general to machines for cutting sheet material, and, more particularly, to an improved blade sharpening apparatus for sharpening the cutting edges of a blade on a numerically controlled cutting machine of the type used in cutting pattern pieces from sheet material layups.

The use of numerically controlled cutting machines in the garment, and other industries where fabric cutting is required is well established. Such numerically controlled machinery is capable of cutting large quantities of pattern pieces from layups of sheet material with high speed and accuracy. Cutting programs control the operation of the cutting tool, such as a reciprocating cutting blade, and cause it to translate through the material layup held in a spread condition on a cutting table.

Numerically controlled cutting machinery has been developed which utilizes a vertically reciprocating blade sharpened along both its leading and lower edges. The known machinery, which may be used to cut material with both slicing and chopping action, has proven particularly advantageous for use in cutting tough materials, and for cutting relatively high piles of such materials. However, to maintain the efficiency and speed of such machinery the blade must be consistently maintained in a uniformly sharp condition.

Blade sharpening apparatus and methods of sharpening have been available for sharpening both the leading and lower edges of reciprocating cutting blades on cutting machines of the aforedescribed general type. Typical blade sharpeners which utilize known methods of sharpening are illustrated and described in my U.S. Pat. Nos. 4,294,047, issued October 13, 1984, and 4,033,214, issued July 5, 1977, and both assigned to the assignee of the present invention, and in U.S. Pat. No. 3,507,177, to Baldwin.

The known cutting machines generally comprise a reciprocating cutting blade suspended from a platform for rotation about an axis perpendicular to the material layup support surface. A blade sharpening apparatus is also suspended from the cutting platform for rotation with the blade about the perpendicular axis, and comprises a sharpening wheel for engagement with the confronting side of the cutting edge of the blade. The sharpening wheel is mounted for rotation on a shaft and has an abrasive surface arranged adjacent the cutting edge of the blade. When the sharpening wheel is precisely aligned with the cutting blade, there is complete surface contact between the abrasive surface and the cutting edge of the blade during sharpening engagement, and therefore effective sharpening occurs. However, only single point or zero contact between the grinding surface and the cutting edge of the blade is maintained if there is not precise alignment, which may be caused by a misaligned wheel, shaft or skewed cutting blade. This condition permits only a limited length of the cutting edge of the blade to be sharpened, at least until a portion of the cutting edge or abrasive surface becomes deformed to allow complete surface contact.

In order to control this undesirable condition, the blade sharpness must be adjusted frequently to maintain consistently precise sharpening wheel and blade alignment for effective sharpening. As a result, the known blade sharpeners have proven to be relatively costly and inefficient in operation.

It is accordingly a general object of the present invention therefore to provide an improved blade sharpening apparatus for sharpening the cutting edges of a blade on a cutting machine without the drawbacks and disadvantages of known blade sharpening apparatus.

SUMMARY OF THE INVENTION

In accordance with the present invention, an improved blade sharpening apparatus is provided for use in a cutting machine having a blade with a cutting edge supported for vertical reciprocating movement relative to sheet material on a horizontal supporting surface. The blade support and blade are oriented in a selected cutting direction about an axis perpendicular to the horizontal supporting surface by an orientation drive motor.

The improved blade sharpening apparatus comprises at least one sharpening wheel suspended from the blade support adjacent the cutting edge of the blade, and is mounted on a shaft for rotation about the shaft axis. The sharpening wheel has an abrasive surface for sharpening when the sharpening wheel is engaged with the cutting edge of the blade. The abrasive surface is coaxially disposed about an axis of symmetry and the axis of symmetry is arranged in angular relation to the shaft axis. This configuration produces a wobble of the abrasive surface during rotation of the sharpening wheel on the shaft, and ensures contact between a limited projecting portion of the abrasive surface and the cutting edge of the blade during the sharpening operation. The wobble and reciprocation of the cutting blade bring about this contact of the abrasive surface and the cutting edge at randomly distributed points and cause the entire cutting edge to become sharpened. Therefore, unlike known blade sharpening apparatus, the present invention does not require precise alignment between the sharpening wheel and the cutting blade to achieve effective sharpening.

In a preferred embodiment the sharpening wheel is adjustably mounted for periodic indexing about the axis of symmetry in order to distribute wear along different portions of the abrasive surface.

DESCRIPTION OF THE PREFERRED EMBODIMENTS

Figure 1:
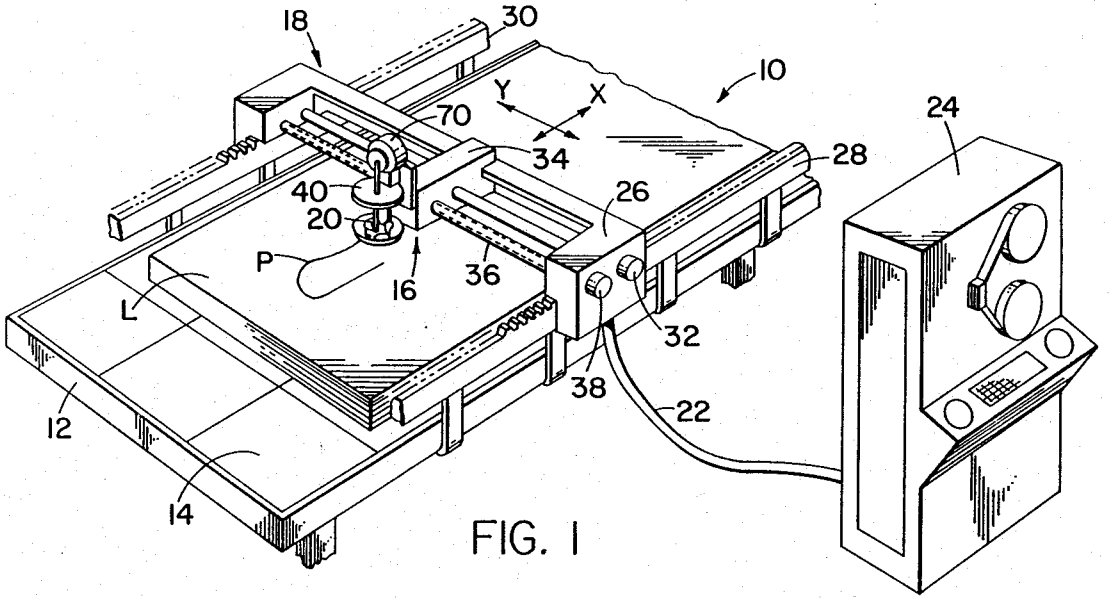
FIG. 1 is a fragmentary perspective view of a numerically controlled cutting machine for cutting limp sheet material and incorporates the improved blade sharpening apparatus which is also used in practicing the method of the present invention.

Referring now to the drawings, FIG. 1 illustrates a cutting machine, generally designated 10, which employs the improved blade sharpening apparatus and method of the present invention. The cutting machine comprises a cutting table 12 which has a penetrable support surface 14, upon which a multi-ply layup L of sheet material shown in FIG. 1 is supported. The layup L may be any of a variety of limp sheet materials including woven and non-woven fabrics, paper, cardboard, leather, rubber and synthetics. A cutting head generally designated 16, supported above the surface 14 on a moveable carriage assembly, generally designated 18, carries a reciprocating cutting blade 20. An electrical cable 22 connects the machine 10 to a controller 24, which operates under a machine command program for guiding the reciprocating blade 20 along a cutting path P, in cutting engagement with the layup L. The path P may, for example, form the periphery of a pattern piece of a specific garment or upholstery panel.

The carriage assembly 18 includes an X-carriage 26 which translates relative to the support surface 14 in the illustrated X-coordinate direction on a set of racks 28 and 30. Pinions (not shown) connected with the X-carriage drivingly engage the racks 28 and 30 respectively and are driven by an X-drive motor 32 in response to signals received from the controller 24. The carriage assembly 18 further includes a Y-carriage 34 which is mounted on the X-carriage 26 and is driven by a lead screw 36 and associated Y-drive motor 38 in response to signals received from the controller 24 for movement in the Y-coordinate direction relative to the X-carriage and the support surface 14. The cutting head 16 is carried on a platform 40 mounted on a projecting end of the Y-carriage 34.

Figure 3:
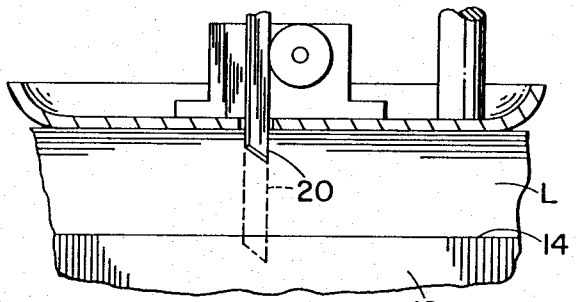
FIG. 3 is a fragmentary side elevation view similar to FIG. 2 but shows the blade in the cutting region.
Figure 6:
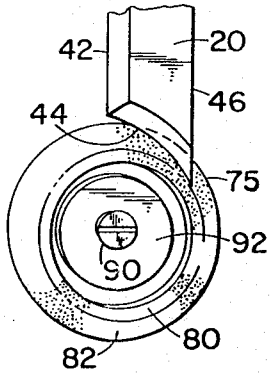
FIG. 6 is a fragmentary side elevation view of the sharpening wheel and blade as shown in FIG. 4.
Figure 2:
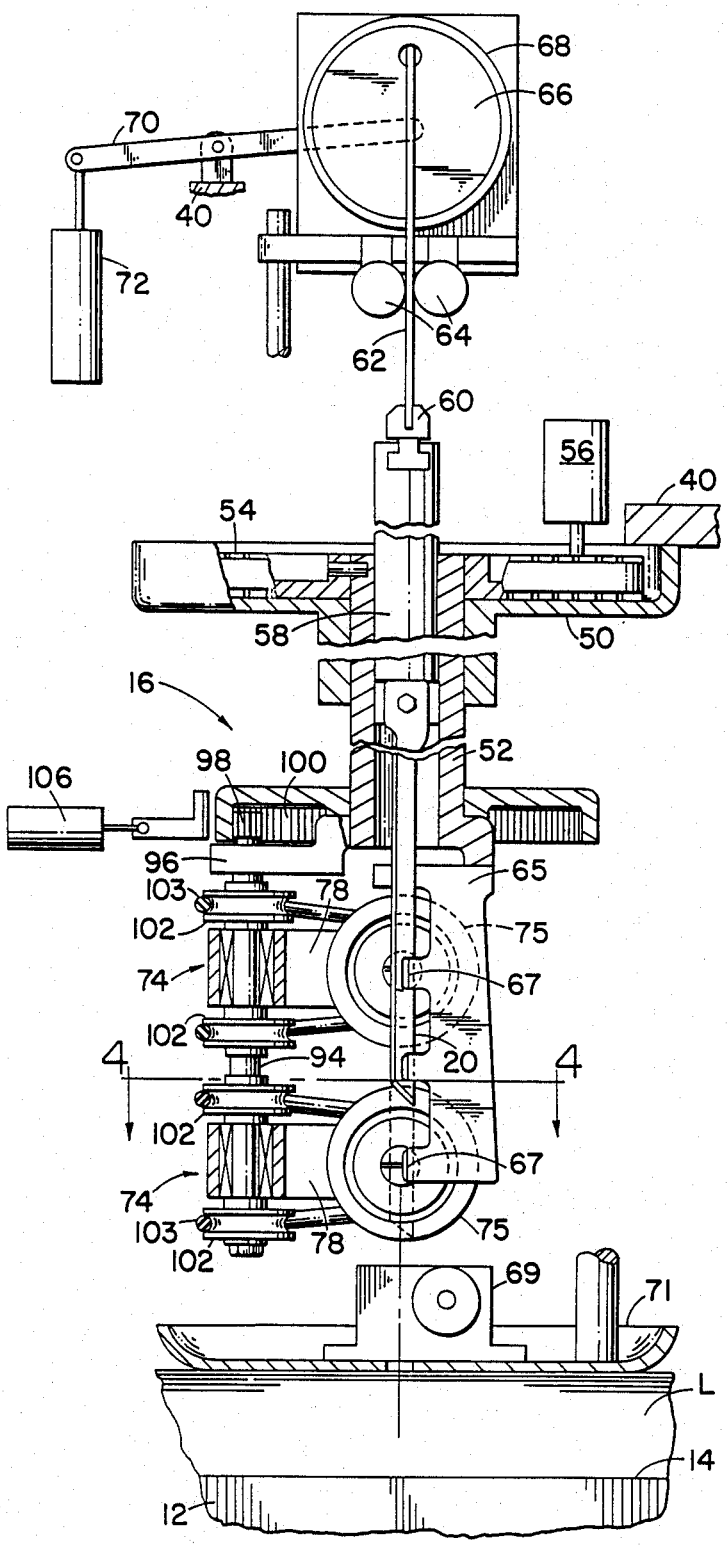
FIG. 2 is an enlarged fragmentary side elevation view of the cutting head of the machine of FIG. 1 and illustrates the improved blade sharpening apparatus and the sharpening method of the present invention.

The blade 20, as best shown in FIGS. 2, 3 and 6, is supported for vertical reciprocation and has a generally vertically extending leading cutting edge 42 and a lower cutting edge 44 which intersects the leading cutting edge and extends downwardly and rearwardly toward the blade trailing edge 46.

In FIG. 2 further details of the cutting head are shown schematically. The cutting head comprises a housing 50 fixed to the platform 40. A hollow sleeve or shaft 52 is journaled in the housing 50 for rotation about a $\theta$-axis perpendicularly arranged in relation to the support surface 14. A belt driven pulley 54 is keyed to the upper end of the sleeve 52 within the housing 50, and is driven by a $\theta$-drive motor 56, to rotate the sleeve 52, in response to signals from the controller 24. The cutting blade 20 is mounted on the lower end of a link 58 slidably received within a bore in the sleeve 52. The upper end of the link 58 is secured by a swivel connection 60 to a flexible link 62 supported by guide rollers 64, 64. The swivel connection 60 allows the link 58 and cutting blade 20 to rotate with respect to the flexible link 62 about the $\theta$-axis. A blade guide support 65 is fixed to the sleeve 52, and comprises several U-shaped blade guides 67, 67 which project from the side of the blade guide support 65 at vertically spaced positions and are each supported adjacent the cutting blade 20 to confront opposing faces of the blade. The cutting blade 20 is free to reciprocate within the U-shaped blade guides 67, 67 as well as a roller guide 69 in the presser foot 71 suspended below the blade guide support 65. However, when the sleeve 52 and the blade guide support 65 are rotated about the $\theta$-axis under the operation of the $\theta$-drive motor 56, the U-shaped blade guides 67, 67 and roller guide 69 engage the blade 20 and force the blade 20 to also rotate about the $\theta$-axis. The cutting blade 20 is reciprocated by the flexible link 62 which is driven in a reciprocating manner by a rotating eccentric 66 drivingly connected to a motor 68. The blade 20 is therefore supported for reciprocating movement in response to rotation of the eccentric 66 and for rotation about the $\theta$-axis in response to signals received by the drive motor 56 from the controller 24.

The cutting head 16 further comprises a means for elevating and lowering the blade 20 along the $\theta$-axis between a lower cutting region where the cutting blade 20 reciprocates within the full and broken lines shown in FIG. 3, and an upper sharpening region, where the cutting blade 20 is elevated to reciprocate within the full and broken lines shown in FIG. 2. The elevating and lowering means includes a pivoted lever 70, fixed at one end to support the eccentric 66 and mounted to pivot about a horizontal axis fixed relative to the platform 40. A solenoid 72 is connected to the other end of the lever 70 and operates to pivot the lever about its axis in response to signals from the controller 24 to elevate the eccentric, and therefore the blade 20 to reciprocate within the sharpening region, or to lower the blade 20 to reciprocate within the cutting region.

During cutting the blade 20 is lowered under the operation of solenoid 72 into the cutting region and reciprocates in cutting engagement with the layup L, as shown in FIG. 3. The reciprocating blade 20 moves along the cutting path P in response to the movements of the X and Y-carriages 26 and 34 and commands from the programmed controller 24. The blade is oriented about the $\theta$-axis in response to signals received by the drive motor 56 from the controller 24 so that the blade is maintained in generally tangential orientation relative to the cutting path P.

Apparatus of the type hereinbefore described is further illustrated and described in my U.S. Pat. No. 4,033,214 for BLADE SHARPENER, issued July 5, 1977, assigned to the same assignee of the present invention which is hereby adopted by reference as a part of the present disclosure.

Figure 5:
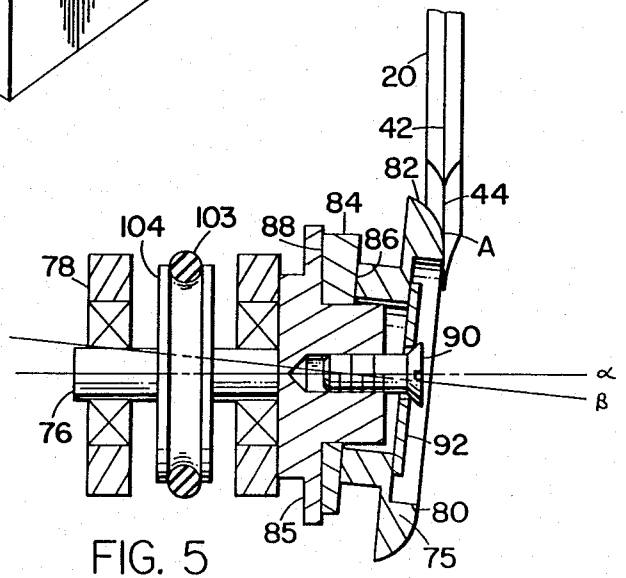
FIG. 5 is a fragmentary sectional view taken along the line 5—5 of FIG. 4.
Figure 4:
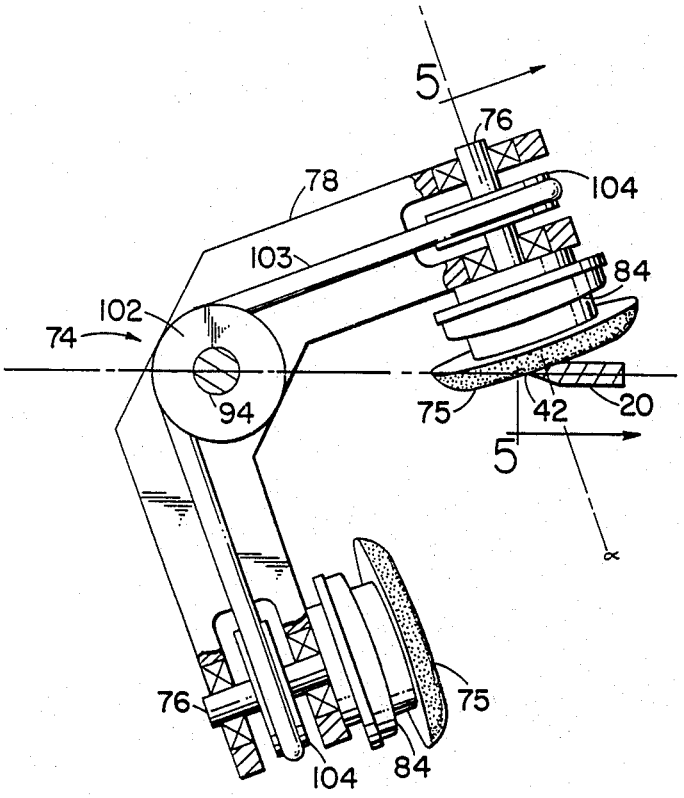
FIG. 4 is a fragmentary sectional view taken along the line 4—4 of FIG. 2.

The improved blade sharpener employed in the illustrated cutting machine 10 includes two sets of sharpening wheels indicated generally 74, 74 as shown in FIG. 2. Each set of wheels 74 includes two sharpening wheels 75, 75, as best illustrated in FIG. 4. Each wheel 75 is fixed to the end of an associated shaft 76 which is journaled for rotation about a horizontal shaft axis $\alpha$ on a yoke 78. Each sharpening wheel 75 has a substantially planar abrasive portion 80 and an annular abrasive portion 82, as best shown in FIGS. 5 and 6.

A wedge shaped washer 84, has a substantially planar and inclined mounting face 86, and an opposing planar face 88, and is fixed between a flange 85 at the end of the shaft 76 and the sharpening wheel 75. The planar face 88 is seated against the flange 85. The sharpening wheel 75 is mounted against the inclined mounting face 86 and fixed to the end of the shaft 76 by means of a screw 90 and flat washer 92, as best shown in FIG. 5. The inclined mounting face 86 places the axis of symmetry $\alpha$ of the planar abrasive portion 80 and annular abrasive portion 82 in angular relation, typically between 2° and 6°, with the associated shaft axis $\alpha$, as illustrated in FIG. 5. The angular relation between the axes $\alpha$ and $\beta$ may be controlled by the inclination of inclined face 86 in relation to the face 88 of the mounting washer 84.

The yokes 78, 78 are eccentrically supported from the $\theta$-axis for rotation on a shaft 94 which is journaled on and suspended from a radial projection 96 on the sleeve 52, as shown in FIG. 2. A pinion 98 is keyed to the upper end of the shaft 94 and intermeshingly engages a ring gear 100 supported for free rotation on the lower end of the sleeve 52. Drive pulleys 102, 102 are keyed to the shaft 94 and are connected by drive belts 103 to associated pulleys 104, 104 keyed to each shaft 76, as shown in FIG. 4. A solenoid operated brake 106 is engageable with the ring gear 100 and operates in response to signals from the controller 24, to secure the ring gear from rotation relative to the platform 40.

During the sharpening cycle the blade 20 is elevated under the operation of the solenoid 72 and lever 70 into the sharpening region, shown in FIG. 2, where the blade is reciprocated under the operation of the rotating eccentric 66 and motor 68. The $\theta$-drive motor 56 is operated by controller 24 to rotate the sleeve 52 and blade 20 about the $\theta$-axis. The controller 24 operates the solenoid driven brake 106 to secure the ring gear 100 from rotation while pinion 98 orbits within the ring gear 100 about the $\theta$-axis with the rotation of the sleeve 52. The orbiting of the pinion 98 rotates the shaft 94 and the pulleys 102, 102 and 104, 104 and hence spins the associated sharpening wheels 75, 75. Because of the eccentric mounting of yokes 78, 78 about the $\theta$-axis centrifugal forces cause one or the other of the sharpening wheels 75, 75, depending upon the direction of rotation of the yokes about the $\theta$-axis, to be biased into sharpening engagement with the blade 20 as the blade reciprocates within the sharpening region.

The skewed mounting of the sharpening wheel 75 ensures engagement between a limited, projecting portion of the abrasive surface, indicated at A in FIG. 5, and the cutting edge of the blade 20 during the sharpening cycle. The rotation of the sharpening wheel and reciprocation of the blade together bring about a random engagement of the portion A with different locations along the cutting edge so that the entire cutting edge of the blade is effectively sharpened, as hereinafter further discussed.

During a sharpening cycle the abrasive portion A of the lower sharpening wheel 75 is allowed to swing under the blade 20 and engage the confronting face of the lower cutting edge 44 at the bottom of the blade sharpening stroke as shown in FIG. 5. The projecting portion A also engages the confronting face on the lower portion of the leading edge 42 when the portion A reaches the uppermost and lowermost positions in each wheel rotation. The projecting portion A also engages the lower cutting edge 44 at the top of the blade sharpening stroke shown in FIG. 2. Likewise, the projecting portion A of the upper wheel 75 engages the confronting face of the upper portion of the leading edge 42 when the portion A is in the uppermost and lowermost positions. The other sharpening wheels 75, 75 at the opposite side of the blade 20 are similarly mounted and are brought into sharpening engagement with the blade by reversing the direction of rotation of the blade 20 about the $\theta$-axis during each sharpening cycle.

It will be further appreciated that the sharpening wheels 75, 75 may be periodically indexed in a rotational manner about each axis of symmetry to distribute wear along the entire abrasive surface of each wheel.

Figure 7:
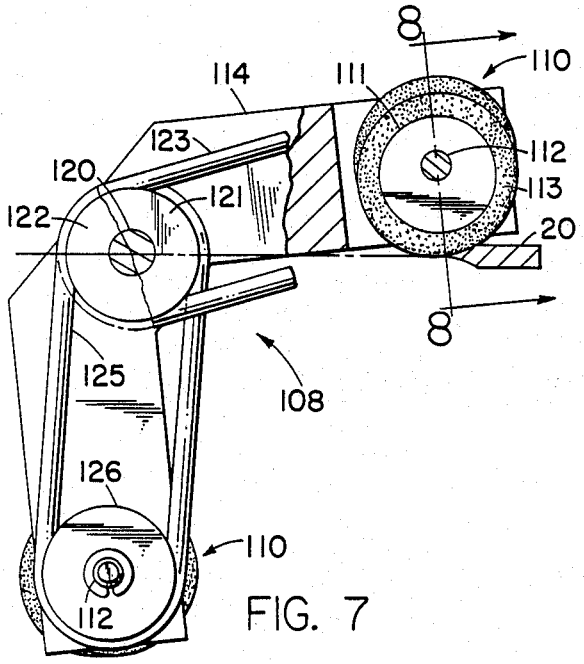
FIG. 7 is a fragmentary sectional view similar to FIG. 4 and illustrates another embodiment of the invention.

In another embodiment of the present invention the improved blade sharpener includes two sets 108 of sharpening wheels wherein each set of wheels 108 includes two cylindrically shaped sharpening wheels indicated generally 110, 110, as shown in FIG. 7, rather than the disk shaped wheels 75, 75 as described in the previous embodiment.

Each wheel 110 comprises a cylindrical hub 111 which is keyed for rotation on a shaft 112. The shaft 112 is journaled for rotation about a vertical axis $\alpha$ on a yoke 114. Each wheel 110 further comprises a bushing 113 which is slidably mounted over the hub 111, and is fixed in position about the hub 111 by means of a set screw 115. Each bushing 113 comprises a substantially cylindrical, abrasive surface 116 which is coaxially disposed about an axis of symmetry $\beta$. The hubs 111 are mounted on their associated shafts 112 so that the axis of symmetry $\beta$ of the abrasive surface 116 is placed in angular relation, typically between 2° and 6°, to the axis of revolution $\alpha$ of the shaft 112, as shown in FIG. 7.

Figure 8:
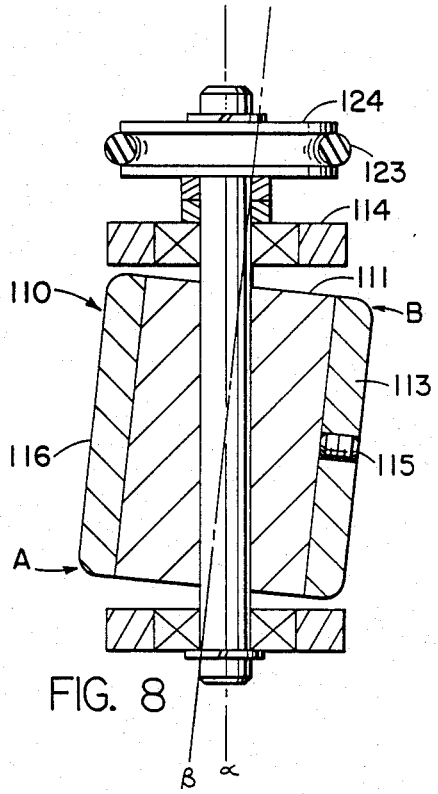
FIG. 8 is a fragmentary sectional view of the sharpening wheel, taken along the line 8—8 of FIG. 7.

The yoke 114 is supported for rotation on a shaft 120 which is suspended, journaled and rotatably driven in the same manner as the shaft 94 set forth in the previous embodiment and shown in FIG. 2. Drive pulleys 121 and 122 are keyed to the shaft 120 and are positioned adjacent one another and above the yoke 114 as shown in FIG. 7. The drive pulley 121 is connected by a drive belt 123 to a pulley 124 keyed to the shaft 112, as best shown in FIG. 8. Similarly, the drive pulley 122 is connected by a drive belt 125 to a pulley 126 which is keyed to the other shaft 112. Rotation of the shaft 120, under the control of the programmable controller as set forth in the previous embodiment, drives the pulleys 121 and 122, which drive the pulleys 124 and 126 respectively, and in turn spin the sharpening wheels 110, 110. An additional set of sharpening wheels, not shown, is suspended below the set of wheels 108 shown in FIG. 7, and is supported on the shaft 120 and driven in the same manner to sharpen the lower portion of the cutting edge of the blade.

During the sharpening cycle centrifugal forces cause the eccentrically mounted yoke 114 to swing one or the other of the cylindrical wheels 110, 110, depending upon the direction of rotation of the yoke about the $\theta$-axis, into sharpening engagement with the blade as the blade reciprocates within the sharpening region. The tilted mounting of the sharpening wheel 110 in relation to the vertical axis $\theta$ensures engagement between limited, projecting portions of the abrasive surface 116, indicated at A and B in FIG. 7, and the confronting face of the cutting edge of the blade. The rotation of the wheel 110 and reciprocation of the blade together bring about a random engagement of the limited portions of the abrasive surface, A and B, with different locations along the cutting edge to effectively sharpen the entire confronting face of the cutting edge of the blade. It will be appreciated that the other sharpening wheel 110 at the opposite side of the blade may be brought into sharpening engagement with the other face of the cutting edge of the blade by reversing the direction of rotation of the blade and its supporting structure about the $\theta$-axis.

It will be further appreciated that the bushing 113 may be periodically indexed about the hub 111 by releasing the set screw 115, rotating the bushing 113, and resetting the set screw 115, to distribute wear throughout the full circumference of the abrasive surface 116.

While the present invention has been described in several preferred embodiments, it will be understood that numerous modifications and substitutions can be had to the specific structures and methods disclosed without departing from the spirit of the invention. For example, it is apparent that the sets of sharpening wheels 74 or 108 may each be utilized without an additional pair of wheels suspended below. Accordingly, the present invention has been described in several preferred embodiments by way of illustration rather than limitation.

I claim:

1. In a cutting machine with a blade supported from a blade support for generally vertical reciprocating movement along an axis perpendicular to a work supporting planar surface and having a cutting edge, a blade sharpener comprising:

at least one sharpening wheel suspended from the blade support and mounted on a shaft adjacent the cutting edge of the blade for rotation about the shaft axis and for sharpening when the sharpening wheel is engaged with the cutting edge of the blade, the sharpening wheel having an abrasive surface coaxially disposed about an axis of symmetry arranged in angular relation to the shaft axis; and drive means for rotating the sharpening wheel on the shaft when engaged with the blade for sharpening the cutting edge of the blade as the blade reciprocates during a sharpening operation.

2. A blade sharpener in a cutting machine as defined in claim 1 wherein:

the abrasive surface of the sharpening wheel comprises an annular surface.

3. A blade sharpener in a cutting machine as defined in claim 2 further including:

a mounting washer having two substantially planar, opposing surfaces, each planar surface disposed about respective axes of symmetry, wherein the axes of symmetry are arranged in angular relation, and a flange arranged on the wheel shaft wherein the mounting washer is fixed between the flange and the sharpening wheel mounted on the end of the wheel shaft to arrange the axis of symmetry of the abrasive surface of the sharpening wheel in angular relation to the axis of the wheel shaft.

4. A blade sharpener in a cutting machine as defined in claim 2 wherein:

the sharpening wheel is adjustably mounted on the wheel shaft for indexing the sharpening wheel in a rotational manner to distribute wear along the abrasive surface.

5. A blade sharpener in a cutting machine as defined in claim 1 wherein:

the abrasive surface of the sharpening wheel is substantially cylindrical in shape.

6. A blade sharpener in a cutting machine as defined in claim 5 wherein:

the sharpening wheel comprises a hub mounted to the shaft and a bushing comprising the abrasive surface, and wherein the bushing is adjustably mounted on the hub for indexing in a rotational manner on the hub to distribute wear along the abrasive surface.

7. A blade sharpener in a cutting machine as defined in claim 1 comprising:

a first sharpening wheel and a second sharpening wheel, each mounted on a respective shaft, and suspended respectively adjacent opposite sides of the cutting edge of the blade for rotation about the respective shaft axes, and each sharpening wheel having an abrasive surface coaxially disposed about a respective axis of symmetry arranged in angular relation to the respective shaft axis, and wherein the drive means is connected in driving relationship with each of the first and the second sharpening wheels.

8. A blade sharpener in a cutting machine as defined in claim 7 further comprising:

a third sharpening wheel and a fourth sharpening wheel each mounted on a respective shaft for rotation about the respective shaft axes, and each sharpening wheel having an abrasive surface coaxially disposed about a respective axis of symmetry arranged in angular relation to the respective shaft axis, and each sharpening wheel is suspended respectively adjacent opposite sides of the cutting edge of the blade and vertically below the first and second sharpening wheels for engagement with different portions of the cutting edge of the blade, and the drive means is connected in driving relationship with each of the third and fourth sharpening wheels.

9. A method for sharpening the cutting edge of a reciprocating blade in a sheet material cutting apparatus, the blade having a cutting edge and being supported above a sheet material supporting surface, the apparatus having a cutting region proximate the sheet material supporting surface and a blade sharpening region above the cutting region, and at least one blade sharpening wheel having an abrasive surface for sharpening the cutting edge of the blade, the wheel being mounted for rotation on a wheel shaft, and selectively engageable with a drive motor for rotation about the wheel shaft axis, said method comprising the following steps:

mounting the sharpening wheel on the wheel shaft to arrange an axis of symmetry of the abrasive surface in angular relation to the wheel shaft axis and project at least one portion of the abrasive surface toward the confronting side of the cutting edge of the blade, elevating the blade from the cutting region to the blade sharpening region and reciprocating the blade within the sharpening region, rotating the sharpening wheel about the wheel shaft axis, and biasing the sharpening wheel toward the cutting edge of the blade, to engage the projecting portion of the abrasive surface with the confronting side of the cutting edge of the blade.

* * * * *